US011468851B2

(12) United States Patent
Nam et al.

(10) Patent No.: US 11,468,851 B2
(45) Date of Patent: Oct. 11, 2022

(54) ORGANIC LIGHT-EMITTING DIODE DISPLAY DEVICE AND DRIVING METHOD THEREOF

(71) Applicant: LG Display Co., Ltd., Seoul (KR)

(72) Inventors: Yousung Nam, Paju-si (KR); Youngchul Kwon, Seongnam-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/125,099

(22) Filed: Dec. 17, 2020

(65) Prior Publication Data

US 2021/0201830 A1 Jul. 1, 2021

(30) Foreign Application Priority Data

Dec. 31, 2019 (KR) ..... 10-2019-0179967

(51) Int. Cl.

| | |
|---|---|
| ***G09G 3/3291*** | (2016.01) |
| ***G09G 3/3275*** | (2016.01) |
| ***G09G 3/3225*** | (2016.01) |
| ***G09G 3/3266*** | (2016.01) |

(52) U.S. Cl.

CPC ..... *G09G 3/3291* (2013.01); *G09G 2310/08* (2013.01); *G09G 2320/043* (2013.01)

(58) Field of Classification Search

CPC ..... G09G 2310/0297

See application file for complete search history.

(56) References Cited

U.S. PATENT DOCUMENTS

| | | | | |
|---|---|---|---|---|
| 8,791,892 | B2 * | 7/2014 | Kim | G09G 3/3688 345/94 |
| 9,262,974 | B2 | 2/2016 | Lee | |
| 9,472,140 | B2 * | 10/2016 | Kanda | G09G 3/325 |
| 9,552,774 | B2 * | 1/2017 | Jeong | G09G 3/3275 |

(Continued)

FOREIGN PATENT DOCUMENTS

| | | | |
|---|---|---|---|
| CN | 102243839 | A | 11/2011 |
| CN | 103871357 | A | 6/2014 |

(Continued)

OTHER PUBLICATIONS

Indian Patent Office, Office Action, IN Patent Application No. 202014055772, dated Jul. 27, 2021, five pages.

(Continued)

*Primary Examiner* — Sepehr Azari

(74) *Attorney, Agent, or Firm* — Fenwick & West LLP

(57) ABSTRACT

Disclosed is an organic light-emitting diode display device including: a display panel in which pixels adjacent to each other are paired and arranged to share a single data line in pixel areas defined by gate and data lines; a gate driver configured to drive the plurality of gate lines; a data driver configured to output a data voltage to data voltage output channels on the basis of an arrangement of pixels; a data switcher configured to alternately select a data line and to electrically connect the data line with the data voltage output channel of the data driver; and a timing controller configured to control the data switcher and the gate and data drivers, thereby making it possible to drive a data driving circuit at high driving frequency and to reduce a deterioration of image quality and image distortion even in a simplified structure of the data driving circuit.

16 Claims, 5 Drawing Sheets

(56) References Cited

U.S. PATENT DOCUMENTS

| | | | | |
|---|---|---|---|---|
| 10,074,316 | B2 | 9/2018 | Fu et al. | |
| 10,373,547 | B2 | 8/2019 | Sun et al. | |
| 10,388,214 | B2 | 8/2019 | Na | |
| 10,685,605 | B2 | 6/2020 | Na et al. | |
| 2008/0055304 | A1* | 3/2008 | Ryu | G09G 3/2022 345/214 |
| 2011/0273408 | A1 | 11/2011 | Ra et al. | |
| 2011/0279437 | A1 | 11/2011 | Komiya et al. | |
| 2012/0146964 | A1* | 6/2012 | Kim | G09G 3/3688 345/204 |
| 2013/0215090 | A1* | 8/2013 | Kim | G09G 3/3648 345/204 |
| 2014/0152639 | A1* | 6/2014 | Bang | G09G 3/3233 345/212 |
| 2014/0160172 | A1 | 6/2014 | Lee | |
| 2014/0240379 | A1* | 8/2014 | Jeong | G09G 3/3275 345/691 |
| 2015/0029238 | A1* | 1/2015 | Kanda | G09G 3/3291 345/690 |
| 2015/0061983 | A1* | 3/2015 | Kim | G09G 3/3275 345/82 |
| 2015/0091883 | A1 | 4/2015 | Pyun et al. | |
| 2016/0078826 | A1 | 3/2016 | Yoo et al. | |
| 2016/0155379 | A1 | 6/2016 | Na | |
| 2016/0189600 | A1 | 6/2016 | Shin et al. | |
| 2016/0189670 | A1 | 6/2016 | Kim et al. | |
| 2017/0061865 | A1* | 3/2017 | Park | G09G 3/325 |
| 2017/0301278 | A1 | 10/2017 | Sun et al. | |
| 2018/0033376 | A1 | 2/2018 | Fu et al. | |
| 2018/0083078 | A1* | 3/2018 | Park | H01L 51/102 |
| 2018/0218673 | A1* | 8/2018 | Li | G09G 3/3233 |
| 2019/0189059 | A1 | 6/2019 | Na et al. | |

FOREIGN PATENT DOCUMENTS

| | | | |
|---|---|---|---|
| CN | 105096809 | A | 11/2015 |
| CN | 105575333 | A | 5/2016 |
| CN | 106205480 | A | 12/2016 |
| CN | 109599073 | A | 4/2019 |
| CN | 109949740 | A | 6/2019 |
| KR | 10-2008-0002427 | A | 1/2008 |

OTHER PUBLICATIONS

Taiwan Intellectual Property Office, Office Action, TW Patent Application No. 109131383, dated Sep. 13, 2021, 19 pages.

* cited by examiner

ORGANIC LIGHT-EMITTING DIODE DISPLAY DEVICE AND DRIVING METHOD THEREOF

CROSS-REFERENCE TO RELATED APPLICATION

This application claims priority to and the benefit of Republic of Korea Patent Application No. 10-2019-0179967, filed on Dec. 31, 2019, the disclosure of which is incorporated herein by reference in its entirety.

BACKGROUND

1. Technical Field

The present disclosure relates to an organic light-emitting diode display device and a driving method thereof that can reduce a deterioration of image quality and image distortion even during a high-speed drive.

2. Description of Related Art

Flat panel-type image display devices are used for various electronic devices including mobile phones, tablet PCs, laptops and the like. Liquid crystal display devices, organic light-emitting diode display devices, electrowetting display devices, field emission devices and the like are used as a flat panel-type image display device.

Liquid crystal display devices, organic light-emitting diode display devices and the like adjust an amount of transmitted light or emitted light of each pixel to display an image through an image display panel where a plurality of pixels are arranged in a matrix form. To this end, panel driving circuits for driving pixels of the image display panel are mounted onto or electrically connected with the image display panel.

The organic light-emitting diode display device includes color filters such as red, green and blue color filters in each pixel area where an organic light-emitting diode is disposed, and each pixel emits red, green and blue light to display a color image.

In recent years, as the organic light-emitting diode display device is applied to a wide range of devices such as mobile communication devices, tablet PCs, laptops and the like, there is a growing need for improvement and enhancement in the application of the organic light-emitting diode display device to a wider range of devices.

SUMMARY

As a means to improve applicability of the organic light-emitting diode display device to mobile communication devices, tablet PCs, laptops and the like, a method of correcting image data or varying an arrangement of pixels of an image display panel and the like has been presented.

As an example, output channels, from which image signals are output, are alternately connected to a pair of data lines adjacent to each other, and the image signals are alternately supplied to the pair of data lines, thereby making it possible to simplifying a structure of a data driving circuit.

Further, pixels adjacent to each other share a single data line, and an image display panel is driven according to a double rating driving (DRD) method, thereby making it possible to simplify a structure of a data driving circuit.

In recent years, a driving frequency of the image display panel is changed to vary an image display speed. In case a driving frequency is increased to drive the image display panel at high speed, a driving period of pixels may be shortened. As a result, images may be distorted.

In a simplified structure and the like of a data driving circuit where an image signal is switched and alternately output or where pixels adjacent to each other are alternately driven, it is difficult to increase driving frequencies of the data driving circuit.

The present disclosure is directed to an organic light-emitting diode display device and a driving method thereof that may prevent a deterioration of image quality and image distortion even when an image display panel to which a simplified data driving circuit is applied is driven at high speed.

The present disclosure is directed to an organic light-emitting diode display device and a driving method thereof that may prevent a deterioration of image quality and image distortion even in a simplified structure of a data driving circuit where an image signal is switched and alternately output and where pixels adjacent to each other are alternately driven although the data driving circuit is driven at high driving frequencies.

Aspects of the present disclosure are not limited to what has been described. Additionally, other aspects and advantages that have not been mentioned may be clearly understood from the following description by one having ordinary skill in the art to which the disclosure pertains.

In a display panel of an organic light-emitting diode display device according to an embodiment, pixels adjacent to each other along a direction of a gate line may be paired and arranged to share a single data line. Accordingly, a total number of data lines may be half (½) a total number of pixel columns, and a plurality of R, G and B pixels or R, G, B and W pixels may be driven according to the double rating driving method (DRD).

To this end, a timing controller may align and output image data such that the entire pixels are driven and emit light according to the DRD method while mutually adjacent data lines of the display panel are alternately driven at least within a 1 horizontal period. In this case, the timing controller may align and output image data such that a pair of mutually adjacent pixels that share a data line continues to emit light consecutively at least as a unit of the 1 horizontal period.

A data switcher may be provided with a plurality of multiplexer or multiplexer circuits comprised of a plurality switching elements. The data switcher may electrically connect $2i-1^{th}$ and $2i^{th}$ data lines with a data voltage output channel such that the 2i- and $2i^{th}$ data lines are alternately driven according to first and second selection signals input by the timing controller.

A gate driver may consecutively generate first gate-on signals according to a gate control signal and may consecutively supply the gate-on signals to pixels in odd-number columns on the basis of a connection structure of gate lines. Next, the gate driver may consecutively generate second gate-on signals according to the gate control signal and consecutively supply the gate-on signals to pixels in even-number columns on the basis of the connection structure of gate lines. Additionally, the gate driver may consecutively generate a plurality of light-emission control signals in response to the gate control signal, may consecutively supply each of the light-emission control signals to each light-emission control line.

An organic light-emitting diode display device and a driving method thereof according to embodiments of the present disclosure may be driven at increased driving frequencies and may prevent a deterioration of image quality and image distortion even in a simplified structure of a data driving circuit where an image signal is switched and alternately output and where pixels adjacent to each other are alternately driven.

Details in the above-described problems, solutions and effects are not intended to specify essential features in the appended claims. Thus, the scope of the right to the claims is not limited only according to the details in the specification.

BRIEF DESCRIPTION OF THE DRAWINGS

The accompanying drawings constitute a part of this specification, illustrate one or more embodiments of the present disclosure and together with the specification, and explain the present disclosure, wherein.

DETAILED DESCRIPTION

Figure 1:
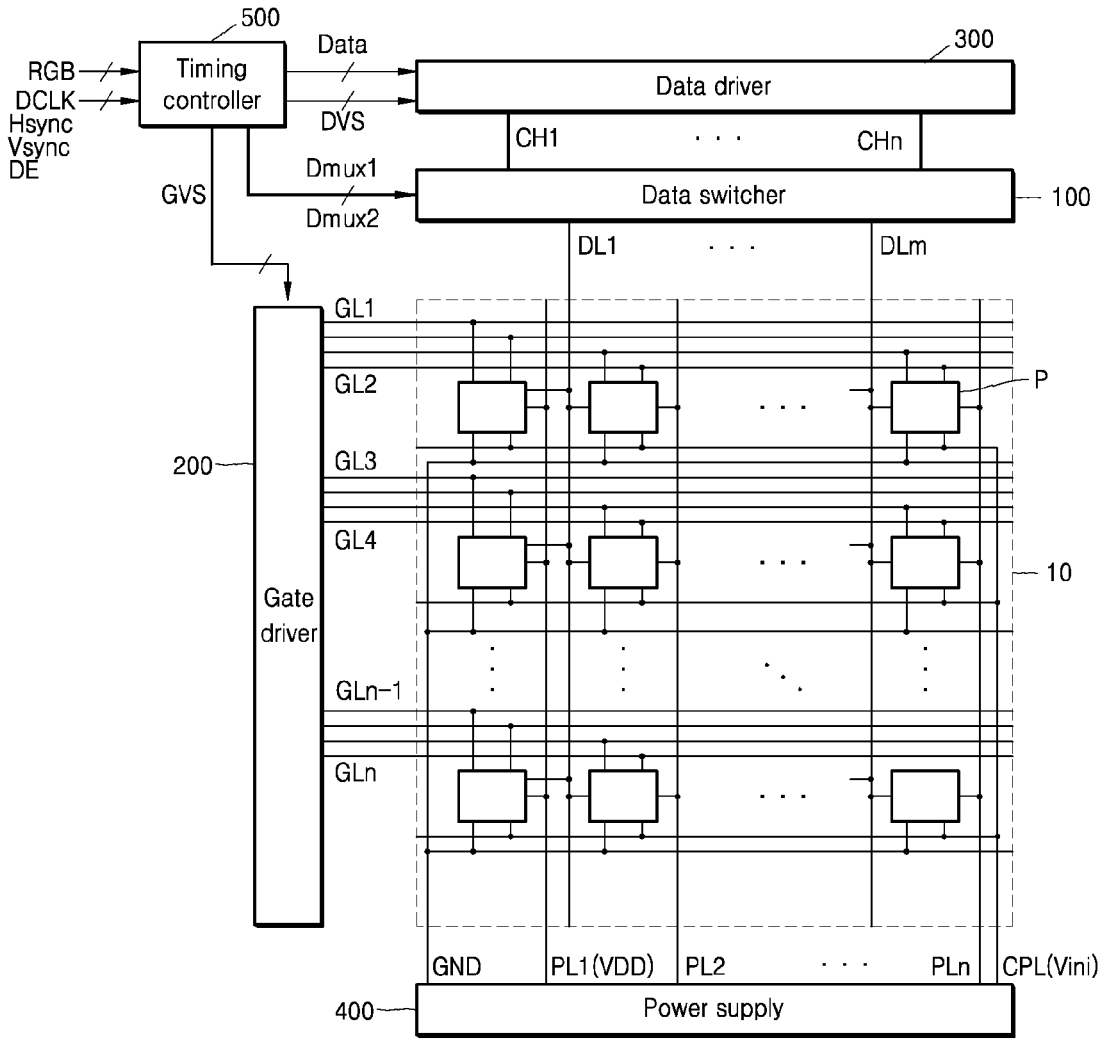
FIG. 1 is a block diagram specifically illustrating an organic light-emitting diode display device according to an embodiment of the present disclosure.

Advantages and features of the present disclosure and a method of achieving the same may be clearly understood from embodiments that are described with reference to the accompanying drawings. The present disclosure, however, may be implemented in various different forms, and should not be construed as being limited only to the embodiments set forth herein. Rather, these embodiments are provided as examples so that the present disclosure will be thorough and complete and that the scope of the disclosure will be fully conveyed to one having ordinary skill in the art to which the disclosure pertains. The present disclosure should be defined only according to the scope of the appended claims.

The shapes, sizes, ratios, angles and number of components illustrated in the drawings of the present disclosure are given only as examples, and the present disclosure is not limited to details set forth herein. Throughout the specification, like reference numerals denote like components. In describing the present disclosure, detailed description of well-known technologies including related arts will not be specifically described if it is deemed to make the gist of the disclosure unnecessarily vague. Throughout the specification, unless explicitly indicated otherwise, the terms "comprise", "have", "being comprised of" and the like should imply the inclusion of any other component but not the exclusion of any other component, and the singular forms "a", "an" and "the" are intended to include the plural forms as well.

In describing a component, the margin of error should be considered though not explicitly described. When spacial terms such as "on", "at an upper portion", "at a lower portion", "being adjacent to" and the like are used in the present disclosure, one or more additional components may be interposed between two components unless terms such as "right" or "directly" are used.

When temporal terms such as "after", "next", "following", "before" and the like are used to describe a temporal order, one or more additional events may be interposed between two events unless terms such as "right" or "directly" are used.

Features of various embodiments of the disclosure may be partially or entirely mixed or combined, and may be technically linked and connected in various ways. Further, each embodiment may be implemented independently, or in connection with each other.

Below, an organic light-emitting diode display device and a driving method thereof according to embodiments the present disclosure are described with reference to the accompanying drawings.

FIG. 1 is a block diagram specifically illustrating an organic light-emitting diode display device according to an embodiment of the present disclosure.

The organic light-emitting diode display device in FIG. 1 may include an organic light-emitting diode display panel 10 (referred to as a "display panel"), a gate driver 200, a data driver 300, a data switcher 100, a power supply 400, and a timing controller 500.

The display panel 10 may be configured such that a plurality of R, G and B pixels (P) or R, G, B and W pixels (P) are respectively arranged in pixel areas that are defined by gate lines (GL1 to GLn) and data lines (DL1 to DLm) which are crossed. The pixels (P), disposed close to each other along a direction of the gate line (GL1 to GLn), may be paired and arranged to share a single data line (DL1 to DLm). Accordingly, a total number of data lines (DLm) may be half (½) of a total number of pixel columns, and the plurality of R, G and B pixels (P) or R, G, B and W pixels (P) may be driven according to the double rating driving (DRD) method.

A pair of pixels (P) that share a data line respectively may include a pixel circuit connected to a data line (DLm) and a power supply line (PLn) that are shared with another plurality of gate lines (GLn), and an organic light-emitting diode connected between the pixel circuit and a low-potential power signal (GND) supply line. A connection between the gate line (GL1 to GLn) and data line (DL1 to DLm) of the display panel 10 and each pixel (P) is described with reference to the accompanying drawings hereunder.

The timing controller 500 may align and output image data (RGB) such that entire pixels (P) are driven and emit light according to the DRD method while mutually adjacent data lines (DL1 to DLm) of the display panel 10 are driven alternately at least within a 1 horizontal period. The timing controller 500 may align and output image data (RGB) such that pairs of mutually adjacent pixels (P) that share a data line consecutively continue to emit light at least on the basis of a unit of the 1 horizontal period. Below, m, n, and i, which are natural numbers except 0, may be the same or different.

Further, the timing controller 500 may generate a gate control signal (GVS) and a data control signal (DVS) using synchronization signals (DCLK, DE, Hsync and Vsync) and may transmit the same respectively to the gate and data drivers 200,300 such that the gate line (GL1 to GLn) and data line (DL1 to DLm) of the display panel 10 are driven according to the DRD method.

The data driver 300 may receive the image data aligned by the timing controller 500 at least on the basis of a single horizontal line portion. The image data aligned by the timing controller 500 are aligned data such that mutually adjacent pixels (P) are consecutively driven and emit light at least within the 1 horizontal period while the entire pixels (P) are driven according to the DRD method.

Accordingly, the data driver 300 converts the image data that are aligned in each ½ horizontal period on the basis of each ½ horizontal line portion into an analogue data voltage, using a data control signal (DVS), e.g., source start pulse, source shift clock, source output enable signals and the like, such that mutually adjacent data lines (DL1 to DLm) are alternately driven within each horizontal period.

Specifically, the data driver 300 may sample image data, input according to a source shift clock, on the basis of each ½ horizontal line portion and may convert the same into a data voltage. Additionally, the data driver 300 may respond to a source output enable signal and may supply a data voltage of each ½ horizontal line portion to each output channel (CH1 to CHn) in every ½ horizontal period during which a gate-on signal is supplied to each gate line (GL1 to GLn). The data driver 300, as described above, may generate a data voltage such that mutually adjacent pixels that share the data line continue to emit light at least during the 1 horizontal period, and may consecutively supply the data voltage to the output channel (CH1 to CHn) such that the data voltage is synchronized with an output timing of the gate-on signal.

The data switcher 100 may be provided with a plurality of multiplexers or a plurality of multiplexer circuits comprised of a plurality of switching elements. The data switcher 100 may electrically connect $2i-1^{th}$ and $2i^{th}$ data lines with the data voltage output channel (CH1 to CHn) such that the $2i-1^{th}$ and $2i^{th}$ data lines are alternately driven according to first and second selection signals (Dmux1 and Dmux2) input by the timing controller 500.

In other words, the data switcher 100 may respond to the first selection signal (Dmux1) and may electrically connect the $2i-1^{th}$ data lines respectively with a corresponding data voltage output channel (CH1 to CHn) during the ½ or 1 horizontal period. Additionally, the data switcher 100 may respond to the second selection signal (Dmux2) and may electrically connect the $2i^{th}$ data lines respectively with a corresponding data voltage output channel (CH1 to CHn) during a following ½ or 1 horizontal period.

The gate driver 200 may output a gate-on signal to each gate line (GL1 to GLn) in order determined according to a gate control signal (GVS). Specifically, the gate driver 200 may be provided with a built-in circuit such as at least one of a level shifter, a sift register, a delay circuit, and a flip-flop and the like to consecutively generate a gate-on signal (e.g., a scan pulse) according to gate start pulse (GSP), gate shift clock (GSC), gate output enable (GOE) signals and the like included in the gate control signal (GVS). In this case, the gate driver 200 may consecutively generate gate-on signals by shifting the GSP according to the GSC. Additionally, the gate driver 200 may supply the consecutively generated gate-on signals to each gate line (GL1 to GLn) on the basis of a connection structure of the gate lines (GL1 to GLn) of the display panel 10.

As an example, the gate driver 200 may consecutively generate gate-on signals according to the gate control signal (GVS) and may consecutively supply the gate-on signals to pixels in odd-number columns on the basis of the connection structure of gate lines. Additionally, the gate driver 200 may consecutively generate gate-on signals according to the gate control signal (GVS) and may consecutively supply the gate-on signals to pixels in even-number columns on the basis of the connection structure of gate lines.

Further, the gate driver 200 may respond to the gate control signal (GVS), may consecutively generate a plurality of light-emission control signals and may consecutively supply each light-emission control signal to each light-emission control line.

Figure 2:
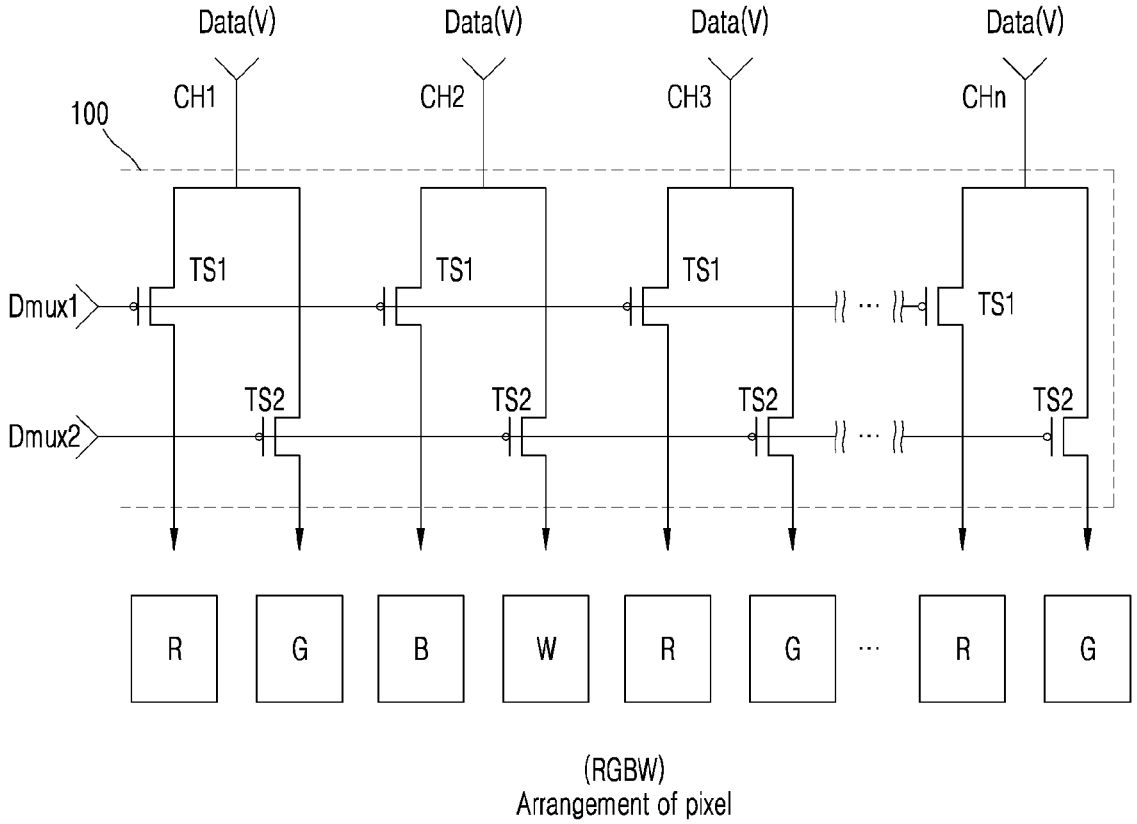
FIG. 2 is a view illustrating the data switcher in FIG. 1 and an arrangement of pixels according to an embodiment of the present disclosure.

FIG. 2 is a view illustrating the data switcher in FIG. 1 and an arrangement of pixels according to an embodiment of the present disclosure.

For the data switcher 100 in FIG. 2, pixels (P) that are adjacent to each other in a direction of the gate line (GL) are respectively paired and are disposed to share a single date line. Accordingly, the data switcher 100 performs a switching operation such that a data voltage output through the data voltage output channels (CH1 to CHn) is alternately transmitted to each of odd-number and even-number data lines (DLm) on the basis of an arrangement of the pixels (P).

Specifically, the data switcher 100 may electrically connect $2i-1^{th}$ and $2i^{th}$ data lines with each data voltage output channel (CH1 to CHn) such that the $2i-1^{th}$ and $2i^{th}$ data lines are alternately driven according to the first and second selection signals (Dmux1 and Dmux2) input by the timing controller 500.

To this end, the data switcher 100 may include a plurality of first conversion switches (TS1) that responds to the first selection signal (Dmux1) input during the ½ or 1 horizontal period and that connects the data voltage output channels (CH1 to CHn) respectively with the $2i-1^{th}$ (odd numbers) data lines, and a plurality of second conversion switches (TS2) that responds to the second selection signal (Dmux2) input during the ½ or 1 horizontal period and that connects the data voltage output channels (CH1 to CHn) respectively with the $2i^{th}$ (even numbers) data lines.

Figure 3:
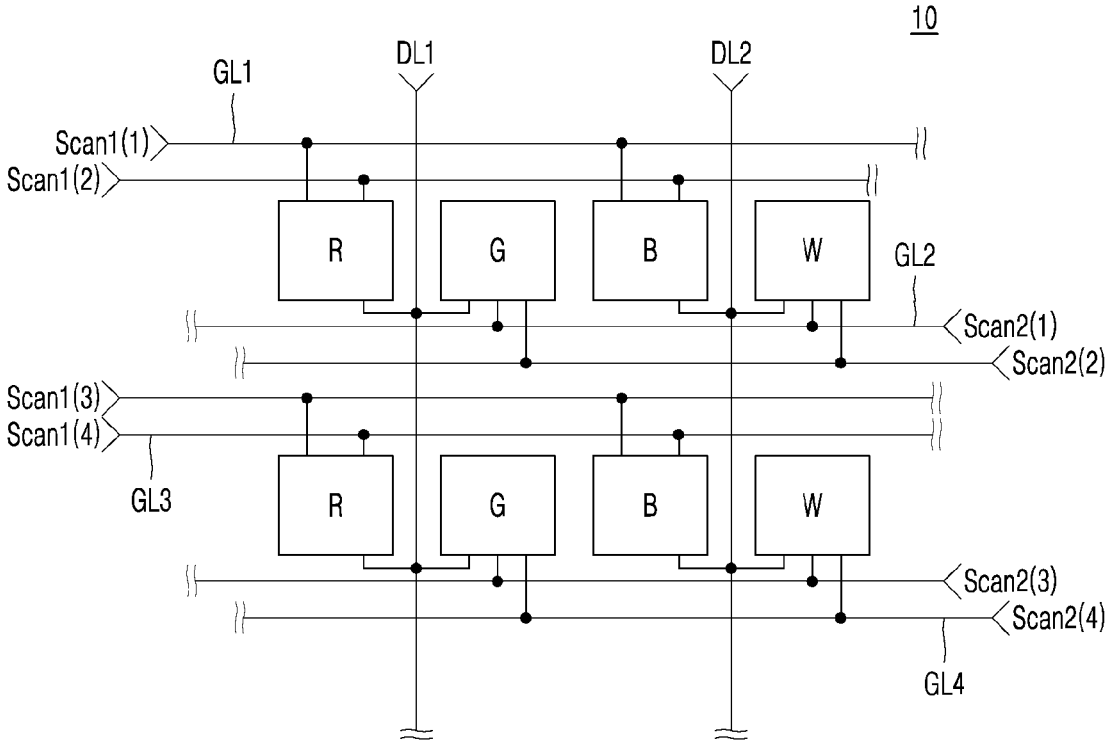
FIG. 3 is a block diagram illustrating an arrangement of pixels of the data line sharing structure in FIG. 1 according to an embodiment of the present disclosure.

FIG. 3 is a block diagram illustrating an arrangement of pixels of the data line sharing structure in FIG. 1 according to an embodiment of the present disclosure.

As illustrated in FIG. 3, for the display panel 10, the entire data lines (DL1 to DLm) may be disposed to be reduced to ½ of the entire pixel columns, and the number of the entire gate lines (GL1 to GLn) may be doubled or quadrupled with respect to the entire pixel rows.

Pixels (P) that are adjacent to each other in the direction of the gate line (GL) are paired and share a single data line. Specifically, $2m-1^{th}$ data lines (DL1, DL3, . . . DL2*m*−1) that are odd-number data lines may be disposed between $4m-3^{th}$ and $4m-2^{th}$ pixel columns, and pixels (red (R) and green (G)) disposed in the $4m-3^{th}$ and $4m-2^{th}$ pixel columns may share the $2m-1^{th}$ data line therebetween.

The $2m^{th}$ data lines (DL2, DL4, . . . DL2*m*) that are even-number data lines may be disposed between $4m-1^{th}$ and $4m^{th}$ pixel columns, and pixels (blue (B) and white (W)) disposed in the $4m-1^{th}$ and $4m^{th}$ pixel columns may share the $2m^{th}$ data line therebetween.

Each pixel (red (R) and blue (B)) disposed in the odd-number columns may be disposed in a pixel area that is defined by two gate lines (e.g., $4n-3^{th}$ and $4n-2^{th}$ gate lines) and a single data line (DL) which are crossed. Each pixel (red (R) and blue (B)) disposed in the odd-number columns may be enabled by a gate-on signal (Scan1(2n−1), Scan1(2n)) consecutively input through the $4n-3^{th}$ and $4n-2^{th}$ gate lines and may display an image according to a light-emission control signal.

Each pixel (green (G) and white (W)) disposed in the even-number columns may be disposed in a pixel area that is defined by two gate lines (e.g., $4n-1^{th}$ and $4n^{th}$ gate lines) and a single data line (DL) which are crossed. Each pixel (green (G) and white (W)) disposed in the even-number columns may be enabled by a gate-on signal (Scan2(2n−1), Scan2(2n)) consecutively input through the $4n-1^{th}$ and $4n^{th}$ gate lines and may display an image according to a light-emission control signal.

Figure 4:
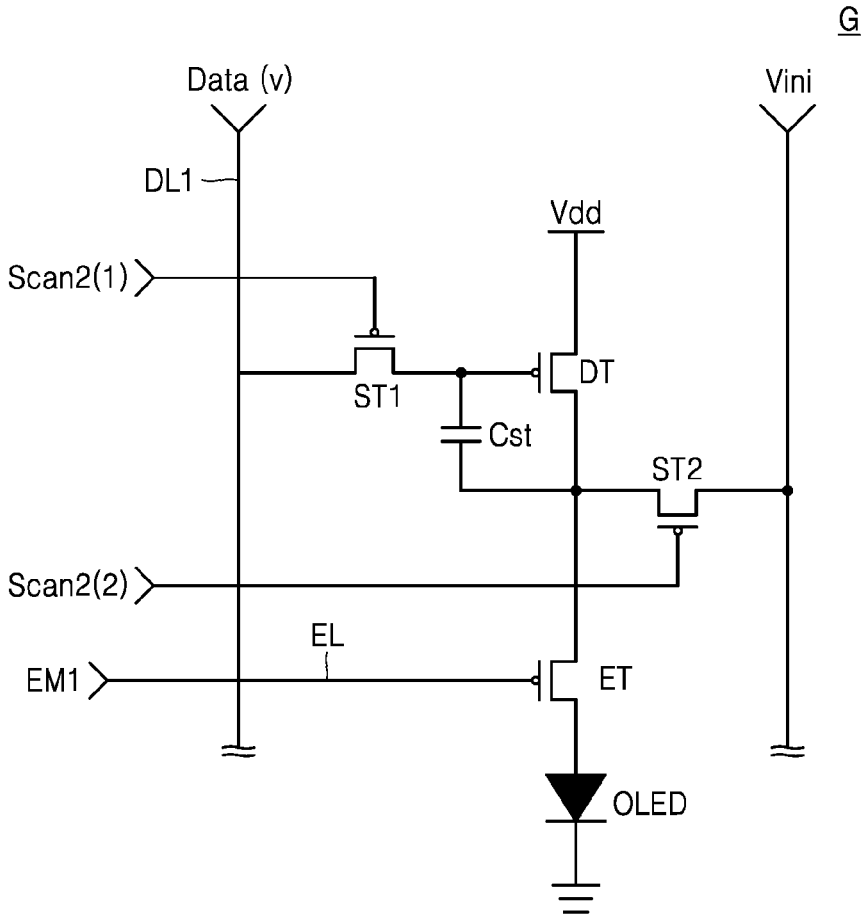
FIG. 4 is a circuit diagram specifically illustrating any one pixel in FIG. 3 according to an embodiment of the present disclosure.
Figure 5:
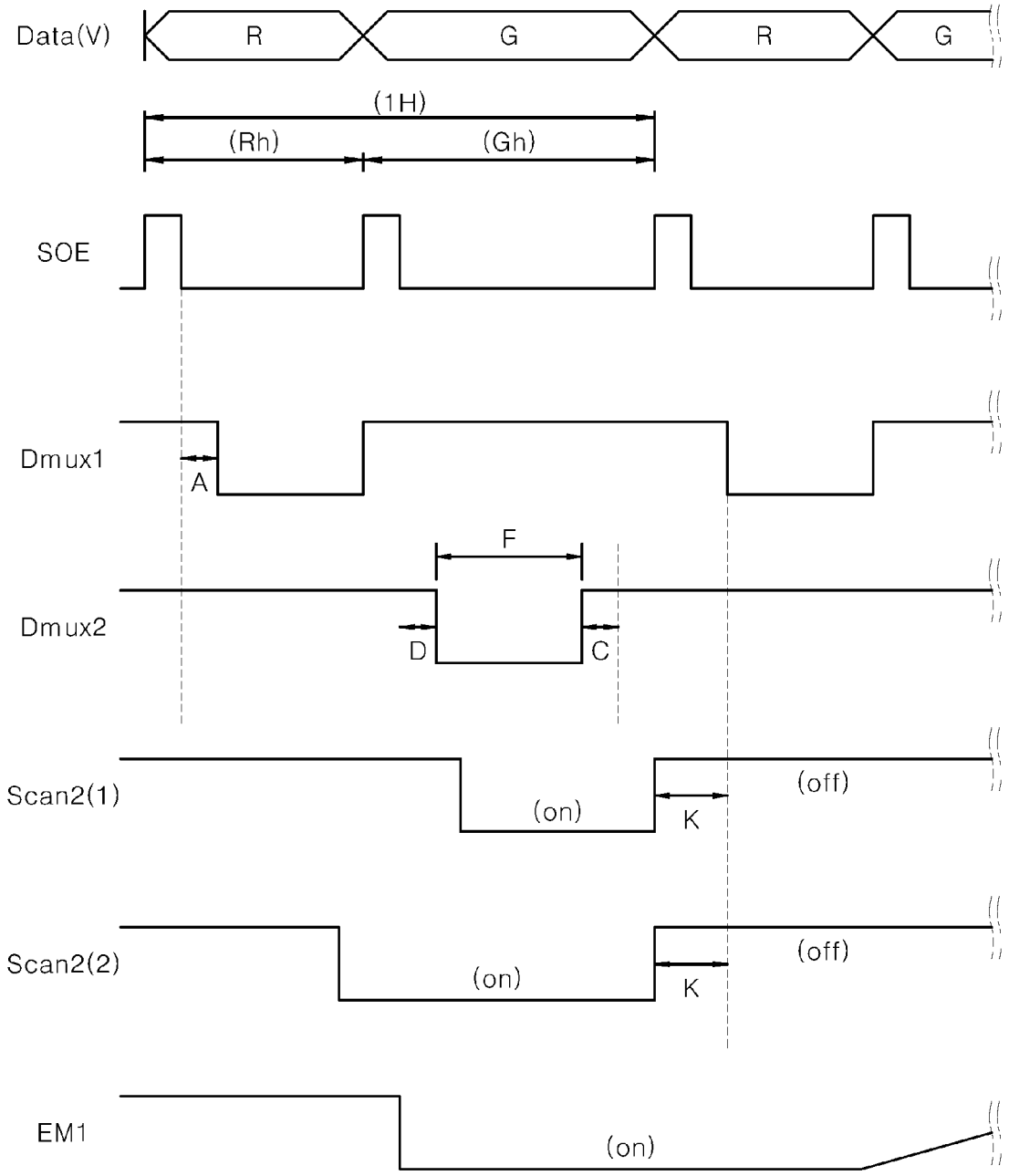
FIG. 5 is a timing chart illustrating control signals input to the data switcher and pixel in FIG. 1 according to an embodiment of the present disclosure.

FIG. 4 is a circuit diagram specifically illustrating any one pixel in FIG. 3 according to an embodiment of the present disclosure, and FIG. 5 is a timing chart illustrating control signals input to the data switcher and pixel in FIG. 1 according to an embodiment of the present disclosure.

Referring to FIG. 4, each pixel (P; e.g., a green pixel (G) disposed in the first row and second column) may include a pixel circuit connected to each of the first and second gate lines (GL1(1) and GL1(2)), an initialization voltage (Vini) input line, a first data line (DL1), a light-emission control line (EL) and the like, and an organic light-emitting diode (OLED) that is connected between the pixel circuit and a low-potential power signal (GND) supply line and that is represented equivalently by a diode.

The pixel circuit may have a source flower-type compensation circuit structure. The pixel circuit may include first and second switching elements (ST1 and ST2), a storage capacitor (Cst), a drive switching element (DT), and a light-emission control element (ET) and the like. The pixel circuit of the disclosure may not be limited to the source flower-type compensation circuit structure, and the structure of the inner compensation circuit may be differently designed.

Referring to FIGS. 4 and 5, the first switching element (ST1) of the pixel circuit may be switched (turned on) by a first gate-on signal (Scan2(1)) from a first gate line (GL1(1)) and may transmit a data voltage input from a corresponding first data line (DL1) to a first node to which a drive switching element (DT) is connected.

In this case, the second switching element (ST2) may be switched (turned on) by a second gate-on signal (Scan2(2)) from a second gate line (GL1(2)) and may supply an initialization voltage (Vini) input from a data driving circuit 300 or a power supply and the like to a second node to which the drive switching element (DT) and the light-emission control element (ET) are connected. The second switching element (ST2) may receive and use additional gate shift clocks or at least one clock pulse and the like as the gate-on signal.

For the drive switching element (DT), a gate terminal may be connected to the first node connected with the first switching element (ST1), a drain terminal may be connected to the second node to which the light-emission control element (ET) is connected, and a source terminal (or a driving voltage input terminal) may be connected to a high-potential voltage source (Vdd). Accordingly, the drive switching element (DT) may allow a threshold voltage (Vth) to be stored in the storage capacitor (Cst) by a data voltage input through the first switching element (ST1) and an initialization voltage (Vini) input through the second switching element (ST2). Additionally, the drive switching element (DT) may supply a driving voltage of an organic light-emitting diode having a magnitude corresponding to magnitude of a voltage of image data where the threshold voltage (Vth) is compensated to the second node to which the light-emission control element (ET) is connected.

The light-emission control element (ET) may supply a driving voltage of an organic light-emitting diode, input to the second node, to the organic light-emitting diode (OLED) for a period during which a light-emission control signal (EM1) is input though the light-emission control line (EL), and may control the organic light-emitting diode (OLED) such that the organic light-emitting diode (OLED) emits light.

Referring to FIG. 5, the first selection signal (Dmux1) generated by the timing controller 500 may be supplied to the data switcher 100 at a low logic voltage level (Dmux1 (on)) that is a turn-on level within a first driving period (Rh) of the 1 horizontal period (1H) such that a data voltage (Data(V)) is supplied to pixels disposed in the $2n-1^{th}$ column (odd-number columns) in a direction of the gate line (GL1 to GLn).

Next, the second selection signal (Dmux2) generated by the timing controller 500 may be supplied to the data switcher 100 at a low logic voltage level (Dmux2(on), period F) that is a turn-on level within a second driving period (Gh) of the 1 horizontal period (1H) such that a data voltage (Data(V)) is supplied to pixels disposed in the $2n^{th}$ columns (even-number columns) in the direction of the gate line (GL1 to GLn). The second driving period (Gh) for driving pixels disposed in the $2n^{th}$ columns (even-number columns) may be longer than the first driving period (Rh) for driving pixels disposed in the $2n-1^{th}$ columns (odd-number columns), out of the 1 horizontal period (1H) (Gh>Rh).

In other words, the first driving period (Rh) for driving pixels disposed in the $2n-1^{th}$ columns (odd-number columns) may be shorter than the second driving period (Gh) for driving pixels disposed in the $2n^{th}$ columns (even-number columns) (Rh<Gh), out of the 1 horizontal period (1H).

At the time of low-speed driving (e.g., a 60-Hz drive), a charge rate has a greater effect on the pixels disposed in the $2n-1^{th}$ columns (odd-number columns) and the $2n^{th}$ columns (even-number columns) than an entire charge period. Accordingly, an image displayed on the pixels disposed in the $2n^{th}$ columns (even-number columns) has no problem.

However, at the time of high-sped driving (e.g., a 90-Hz to 120-Hz or higher drive), the horizontal period (1H) may be shortened or reduced. Accordingly, a charge rate is reduced as a whole. In this case, a charge rate of the pixel in the $2n^{th}$ columns (even-number columns) is affected by a driving period and charge rate of the pixel in the 2n−1th columns (odd-number columns).

To prevent this from happening, in the present disclosure, the second driving period (Gh) for driving the pixels disposed in the $2n^{th}$ columns (even-number columns) during the 1 horizontal period (1H) may be set or changed such that the second driving period (Gh) is longer than the first driving period (Rh) for driving the pixels disposed in the $2n-1^{th}$ columns (odd-number columns).

The first selection signal (Dmux1), which is generated for switching such that a data voltage may be supplied to pixels disposed in the $2n-1^{th}$ columns (odd-number columns), may be delayed for a predetermined period (period A) with respect to a source output enable (SOE) signal generated by the timing generator 500, and may be generated as a turn-on signal.

Additionally, the second selection signal (Dmux2), which is generated for switching such that a data voltage is supplied to the pixels disposed in the $2n^{th}$ columns (even-number columns), and the first selection signal (Dmux1), which is generated for switching such that a data voltage is supplied to the pixels disposed in the $2n-1^{th}$ columns (odd-number columns), may be generated during the same period, or the second selection signal (Dmux2) may be generated during a period 1% to 20% (C or D period) longer than the period of the first selection signal.

That is, a turn on-period of the second selection signal (Dmux2) may be the same as a turn-on period of the first selection signal (Dmux1) or may be generated as a turn-on signal for any one period of C and D periods (1% to 20%) longer than the first selection signal (Dmux1).

When the second driving period (Gh) for driving the pixels disposed in the $2n^{th}$ columns (even-number columns) is longer than the first driving period (Rh) for driving the pixels disposed in the $2n-1^{th}$ columns (odd-number columns), out of the 1 horizontal period (1H), a charge rate of the pixels disposed in the $2n^{th}$ columns (even-number columns) may be improved.

A period during which the first gate-on signal (Scan2(1)) is input as a turn-on signal and a period during which the second gate-on signal (Scan2(2)) is input as a turn-on signal may be set to be longer than a period (an enable period) during which the second selection signal (Dmux2) is input as a turn-on signal, and the first gate-on signal (Scan2(1)) and the second gate-on signal (Scan2(2)) may be input as a turn-on signal even after the second selection signal (Dmux2) is input as a turn-on signal, such that the turn-on signals are input to each pixel. That is, the first and second gate-on signals (Scan2(1) and Scan2(2)) may be input to each pixel (P) as a turn-on signal even after period C during which the second selection signal (Dmux2) is input as a turn-off signal. In this case, the pixels disposed in the $2n^{th}$ columns (even-number columns) may emit light for a longer period and their properties of brightness may be improved.

The period, during which the first selection signal (Dmux1) is generated such that a data voltage is supplied to the pixels (P) of the pixel row in a following column, may be delayed for a predetermined period (period K; e.g., 1.0~1.5 μs) with respect to the period during which the first and second gate-on signals (Scan2(1) and Scan2(2)) supplied to the pixels disposed in the $2n^{th}$ column (an even-number column), i.e., a previous column, are turned on, and then the first selection signal (Dmux1) may be supplied to the data switcher 100. As described above, a predetermined delay (e.g., period K) is interposed between a driving period of the pixels in the $2n^{th}$ column (an even-number column), i.e., the previous column, and a driving period of the pixels (P) of the pixel row in the following column such that a change in charge rates (brightness and saturation) in the following column based on a change in charge periods in the previous column is minimized.

The organic light-emitting diode display device and a driving method thereof according to the embodiments of the present disclosure may be driven at high driving frequencies and may prevent a deterioration of image quality and image distortion even in a simplified structure of a data driving circuit where an image signal is switched and alternately output and where pixels adjacent to each other are alternately driven.

The present disclosure has been described with reference to the embodiments illustrated in the drawings. However, the disclosure is not limited to the embodiments and the drawings set forth herein. Further, various modifications may be made by one having ordinary skill in the art within the scope of the technical spirit of the disclosure. Further, though not explicitly described during description of the embodiments of the disclosure, effects and predictable effects according to the configuration of the disclosure should be included in the scope of the disclosure.

DESCRIPTION OF THE SYMBOLS

10: Display panel
100: Data switcher
200: Gate driver
300: Data driver
400: Power supply
500: Timing controller

What is claimed is:

1. An organic light-emitting diode display device, comprising:

a display panel in which pixels adjacent to each other along a direction of a gate line are paired and arranged to share a single data line in pixel areas defined by a plurality of gate lines and a plurality of data lines;

a gate driver configured to consecutively supply a gate-on signal to the plurality of gate lines;

a data driver configured to output a data voltage to data voltage output channels on a basis of an arrangement of pixels of the display panel such that the data voltage is alternately supplied to the pixels adjacent to each other;

a data switcher configured to alternately select a data line and to electrically connect the data line with the data voltage output channel of the data driver such that the data voltage is alternately supplied to data lines adjacent to each other among the plurality of data lines; and a timing controller configured to respectively generate a first selection signal and a second selection signal for selecting each of the plurality of data lines, and gate control signals and data control signals, and to supply the gate control signals and data control signals to the data switcher, the gate driver, and the data driver, wherein the first selection signal is supplied to the data switcher within a first driving period, and the second selection signal is supplied to the data switcher within a second driving period, and wherein the second driving period is longer than the first driving period during 1 horizontal period, wherein the gate driver supplies a first gate-on signal during the second driving period without supplying the first gate-on signal during the first driving period, and supplies a second gate-on signal during the first driving period and the second driving period.

2. The organic light-emitting diode display device of claim 1, wherein the timing controller is configured to align image data and to supply the image data to the data driver such that the pixels are driven and emit light according to a double rating driving (DRD) method while the data lines adjacent to each other are alternately driven at least within a 1 horizontal period, and to generate the first selection signal and the second selection signal such that the data switcher alternates and electrically connects $2i-1^{th}$ and $2i^{th}$ data lines with data voltage output channels.

3. The organic light-emitting diode display device of claim 2, wherein the data switcher is configured to respond to the first selection signal, and to electrically connect the $2i-1^{th}$ data lines respectively with a corresponding data voltage output channel during a ½ or 1 horizontal period, and to respond to the second selection signal and to electrically connect the $2i^{th}$ data lines respectively with a corresponding data voltage output channel during a following ½ or 1 horizontal period.

4. The organic light-emitting diode display device of claim 2, wherein the gate driver is configured to consecutively generate gate-on signals and to consecutively supply the gate-on signals to pixels in odd-number columns according to a gate control signal, to consecutively generate gate-on signals and to consecutively supply the gate-on signals to pixels in even-number columns according to the gate control signal, and to respond to the gate control signal, to consecutively generate a plurality of light-emission control signals and to consecutively supply each of the light-emission control signals to each pixel through each light-emission control line.

5. The organic light-emitting diode display device of claim 4, wherein the first selection signal is supplied to the data switcher within a first driving period of a 1 horizontal period such that a data voltage is supplied to pixels disposed in $2n\text{-}1^{th}$ columns in a direction of the gate line, and the second selection signal is supplied to the data switcher within a second driving period of a 1 horizontal period such that a data voltage is supplied to pixels disposed in $2n^{th}$ columns in the direction of the gate line.

6. The organic light-emitting diode display device of claim 5, wherein the second driving period for driving pixels disposed in the $2n^{th}$ columns is longer than the first driving period for driving pixels disposed in the $2n\text{-}1^{th}$ columns, out of the 1 horizontal period.

7. The organic light-emitting diode display device of claim 5, wherein the first selection signal is generated to be delayed for a predetermined period with respect to a source output enable signal generated by the timing controller, and the second selection signal is generated during a same period as the first selection signal, or is generated during any one of periods 1% to 20% longer than the first selection signal.

8. The organic light-emitting diode display device of claim 4, wherein a period during which the first gate-on signal is input and a period during which the second gate-on signal is input are longer than a period during which the second selection signal is output, and the first gate-on signal and the second gate-on signal are input even after the second selection signal is output such that the first gate-on signal and the second gate-on signal are input to each pixel.

9. A driving method of a display panel, by which pixels adjacent to each other along a direction of a gate line are paired and arranged to share a single data line in pixel areas defined by a plurality of gate lines and a plurality of data lines, comprising:

supplying a gate-on signal to the plurality of gate lines consecutively;

outputting a data voltage to data voltage output channels on a basis of an arrangement of pixels of the display panel such that the data voltage is alternately supplied to the pixels adjacent to each other;

alternately selecting the data lines and electrically connecting the data lines with the data voltage output channels of a data driver such that the data voltage is alternately supplied to data lines adjacent to each other among the plurality of data lines; and generating a first selection signal and a second selection signal such that the data switcher selects each of the plurality of data lines, and respectively generating gate control signals and data control signals and respectively supplying the gate controls signals and data control signals to a gate driver and a data driver, wherein the first selection signal is supplied to the data switcher within a first driving period, and the second selection signal is supplied to the data switcher within a second driving period, and wherein the second driving period is longer than the first driving period during 1 horizontal period, wherein the gate driver supplies a first gate-on signal during the second driving period without supplying the first gate-on signal during the first driving period, and supplies a second gate-on signal during the first driving period and the second driving period.

10. The method of claim 9, wherein generating of first and second selection signals comprises aligning image data and supplies the image data to the data driver such that the pixels are driven and emit light according to a double rating driving (DRD) method while the data lines adjacent to each other are alternately driven at least within a 1 horizontal period, and generating the first selection signal and the second selection signals such that 2i-1th and $2i^{th}$ data lines are electrically connected alternately with data voltage output channels.

11. The method of claim 10, wherein alternately selecting data lines and electrically connecting the data lines with the data voltage output channels of the data driver, comprises:

responding to the first selection signal and electrically connecting the $2i\text{-}1^{th}$ data lines respectively with a corresponding data voltage output channel during a ½ or 1 horizontal period; and responding to the second selection signal and electrically connecting the $2i^{th}$ data lines respectively with a corresponding data voltage output channel during a following ½ or 1 horizontal period.

12. The method of claim 10, wherein consecutively supplying a gate-on signal to a plurality of gate lines, comprises:

consecutively generating first gate-on signals and consecutively supplying the gate-on signals to pixels in odd-number columns according to a gate control signal;

consecutively generating second gate-on signals and consecutively supplying the gate-on signals to pixels in even-number columns according to the gate control signal; and responding to the gate control signal, consecutively generating a plurality of light-emission control signals and consecutively supplying each of the light-emission control signals to each pixel through each light-emission control line.

13. The method of claim 12, wherein the first selection signal is supplied to the data switcher within a first driving period of a 1 horizontal period such that a data voltage is supplied to pixels disposed in $2n\text{-}1^{th}$ columns in a direction of the gate line, and the second selection signal is supplied to the data switcher within a second driving period of a 1 horizontal period such that a data voltage is supplied to pixels disposed in $2n^{th}$ columns in the direction of the gate line.

14. The method of claim 13, wherein the second driving period for driving pixels disposed in the $2n^{th}$ columns is longer than the first driving period for driving pixels disposed in the $2n\text{-}1^{th}$ columns, out of the 1 horizontal period.

15. The method of claim 13, wherein a period during which the first gate-on signal is input and a period during which the second gate-on signal is input are longer than a period during which the second selection signal is output, and the first gate-on signal and the second gate-on signal are input even after the second selection signal is output such that the first gate-on signal and the second gate-on signal are input to each pixel.

16. The method of claim 12, wherein the first selection signal is generated to be delayed for a predetermined period with respect to a source output enable signal generated by a timing controller, and the second selection signal is generated during a same period as the first selection signal, or is generated during any one of periods 1% to 20% longer than the first selection signal.

* * * * *